US006104594A

United States Patent [19]

Frolov et al.

[11] Patent Number: 6,104,594

[45] Date of Patent: Aug. 15, 2000

[54] ELECTROMAGNETIC LATCH RETRACTOR FOR EXIT BAR

[75] Inventors: George Frolov, Farmington; John E. Walsh, Wallingford; Leon Boiucaner, Farmington, all of Conn.

[73] Assignee: Harrow Products, Inc., Grand Rapids, Mich.

[21] Appl. No.: 09/266,088

[22] Filed: Mar. 10, 1999

[51] Int. Cl.[7] ..... E05C 17/26

[52] U.S. Cl. ..... 361/152; 361/139; 292/251.5

[58] Field of Search ..... 361/139, 152; 292/92, 251.5; 340/542

[56] References Cited

U.S. PATENT DOCUMENTS

| | | | |
|---|---|---|---|
| 4,632,439 | 12/1986 | Miller | 292/166 |
| 5,340,171 | 8/1994 | Slaybuagh et al. | 292/21 |
| 5,429,399 | 7/1995 | Geringer et al. | 292/92 |
| 5,479,151 | 12/1995 | Lavelle et al. | 340/542 |
| 5,496,079 | 3/1996 | Frolov | 292/251.5 |
| 5,517,176 | 5/1996 | Lavelle et al. | 340/542 |
| 5,864,936 | 2/1999 | Riley et al. | 29/434 |

*Primary Examiner*—Michael J. Sherry
*Attorney, Agent, or Firm*—Alix, Yale & Ristas, LLP

[57] ABSTRACT

A exit bar for securing a door has a housing adapted for mounting to a door. A push pad for receiving a push force is mounted to the housing. A latch extends from the housing to releasably latch the door to which the exit bar is mounted. A link system links the push pad to the latch so that a push force exerted on the push pad releases the latch. An electromagnetic disposed in the housing causes an armature to engage the link system to retract the latch. The exit bar further dogs the latch in the unlatched position as long as the power control system for the electromagnet receives an operate signal and for a preestablished delay time after the operate signal has been removed.

18 Claims, 6 Drawing Sheets

ELECTROMAGNETIC LATCH RETRACTOR FOR EXIT BAR

BACKGROUND OF THE INVENTION

This invention relates to the field of door security systems. More specifically, this invention relates to the use of a push or exit bar for securing a doorway.

Push bars or exit bars which allow egress through a doorway while limiting ingress are well-known components of door security and emergency systems. The conventional exit bar is mounted on the interior side of the door to be secured and is oriented generally horizontally across the face of the door. A push force on the bar toward the door face operates a door latch to permit opening of the door. Conventional exit bars typically employ a mechanical linkage to actuate the latch mechanism for unlatching the door. Exit bars may also employ mechanical locks to secure the door from opening. A handle can be additionally provided on the exterior face of the door to allow ingress under certain circumstances. Exit bars have also been connected with alarm systems to warn security personnel of a door opening.

Conventional exit bar systems while enjoying great popularity have also exhibited a number of deficiencies. For example, to secure an exit bar from operating the associated latch may require individually manually locking each bar. For most applications, it is generally undesirable for safety reasons to permanently lock exit bars. Even when a building has low occupancy, there may be times when for emergency reasons, exit doors should not be secured in a permanent fashion that would inhibit egress.

During periods of high traffic levels through a doorway, mechanical latch mechanisms of a conventional exit bar can experience a high rate of wear. To reduce wear on mechanical latch components, some conventional exit bars may be manually locked in a dogged position wherein the latches remain in a retracted state. However, each bar must be directly manually dogged and undogged at the site of the door.

SUMMARY OF THE INVENTION

Briefly stated, the invention in a preferred form is an electromagnetic latch retractor for an exit bar mounted to a face of a door pivotally mounted in a door frame The exit bar includes a housing which is mounted to the door face. A latch extends from the end of the housing proximate the door frame mounted latch strike for releasably latching the door. A push pad defines an exposed push face for receiving a push force and a link system links the pad to the latch for retracting the latch when the pad is pushed. The latch retractor includes an electromagnet mounted within the housing and a power supply for selectively supplying high voltage electrical power to the electromagnet. An armature has an inboard surface disposed oppositely the magnetic face of the electromagnet. The armature is pivotally mounted to the housing at a position intermediate the proximal and distal ends of the armature. The distal end portion of the armature is engageable with the link system. A biasing force biases the proximal end of the armature toward the electromagnet and the distal end of the armature away from electromagnet such that the inboard surface of the armature and the magnetic face of the electromagnet define a wedge-shaped gap. The electromagnet develops a high magnetic field when energized by the high voltage electrical power. The high magnetic field bridges at least a portion of the wedge-shaped gap and imposes a high magnetic force, which is greater than the biasing force, on the armature Consequently, the high magnetic force pushes the distal end of the armature toward the electromagnet such that the distal end portion of the armature engages the link system and moves the link system to retract the latch.

The power supply also selectively supplies low voltage electrical power to the electromagnet after the armature has closed the gap. The electromagnet develops a low magnetic field when energized by the low voltage electrical power which has a sufficient strength to electromagnetically bond the electromagnet and the armature and thereby support the latch in a dogged position.

The latch retractor also includes an armature shroud having a front panel and a pair of legs. The front panel of the armature shroud is disposed intermediate the push pad and the armature. The armature is disposed intermediate the pair of legs. The legs are pivotally mounted, adjacent the proximal end of the armature shroud, to the housing and adjacent the distal end of the armature shroud, to the armature. The armature has an outboard surface disposed oppositely the front panel of the armature. A first spring has an inboard end disposed within a blind bore adjacent the proximal end of the armature. The inboard and outboard ends of the first spring engage the bore end and the armature shroud, respectively, to bias the proximal end of the armature toward the electromagnet. A cup-shaped impact buffer is disposed within a stepped bore adjacent the distal end of the armature. A second spring has an inboard end disposed within a receptacle formed by the impact buffer and an outboard end engaged with the armature shroud. The second spring biases the bumper member of the impact buffer into engagement with the electromagnet and also biases the distal end of the armature shroud away from the electromagnet. Since the distal end of the armature is pivotally mounted to the armature shroud, the second spring also biases the distal end of the armature away from the electromagnet.

The power supply includes a power control system having a charge regulator in electrical communication with the power source and a capacitor in electrical communication with the charge regulator. The charge regulator controls charging of the capacitor to a high voltage level and maintains the capacitor at the high voltage level until the capacitor is selectively discharged through the electromagnet to supply the high initial actuation force. The power control system also has a hold regulator in electrical communication with the power source and the electromagnet. A voltage comparator is in electrical communication with the capacitor and a steering logic module is in electrical communication with the capacitor via a transistor. The steering logic module monitors the voltage charge on the capacitor via the voltage comparator and initiates discharge of the capacitor by the transistor on receipt of an operate signal if the sensed voltage charge is equal to or greater than the high voltage level. If the sensed voltage charge is less than the high voltage level, the steering logic module stores the operate signal and initiates discharge of the capacitor as soon as the sensed voltage rises to the high voltage level. The hold regulator maintains the required holding current in the electromagnet as long as the steering logic module receives the operate signal. A relock timer in electrical communication with the steering logic and the hold regulator provides an output to the hold regulator for a predetermined period of time after the steering logic module stops receiving the operate signal. The hold regulator maintains the electromagnet at the low voltage level as long as the relock timer provides the output.

An object of the invention is to provide a new and improved exit bar that may be unlatched and dogged in the unlatched position without requiring an outside mechanical force to retract the latch.

Another object of the invention is to provide an exit bar having an electromagnetic latch retractor.

A further object of the invention is to provide an exit bar that may be remotely unlatched and dogged in the unlatched position.

Other objects and advantages of the invention will become apparent from the drawings and the specification.

DETAILED DESCRIPTION OF THE PREFERRED EMBODIMENTS

Figure 1:
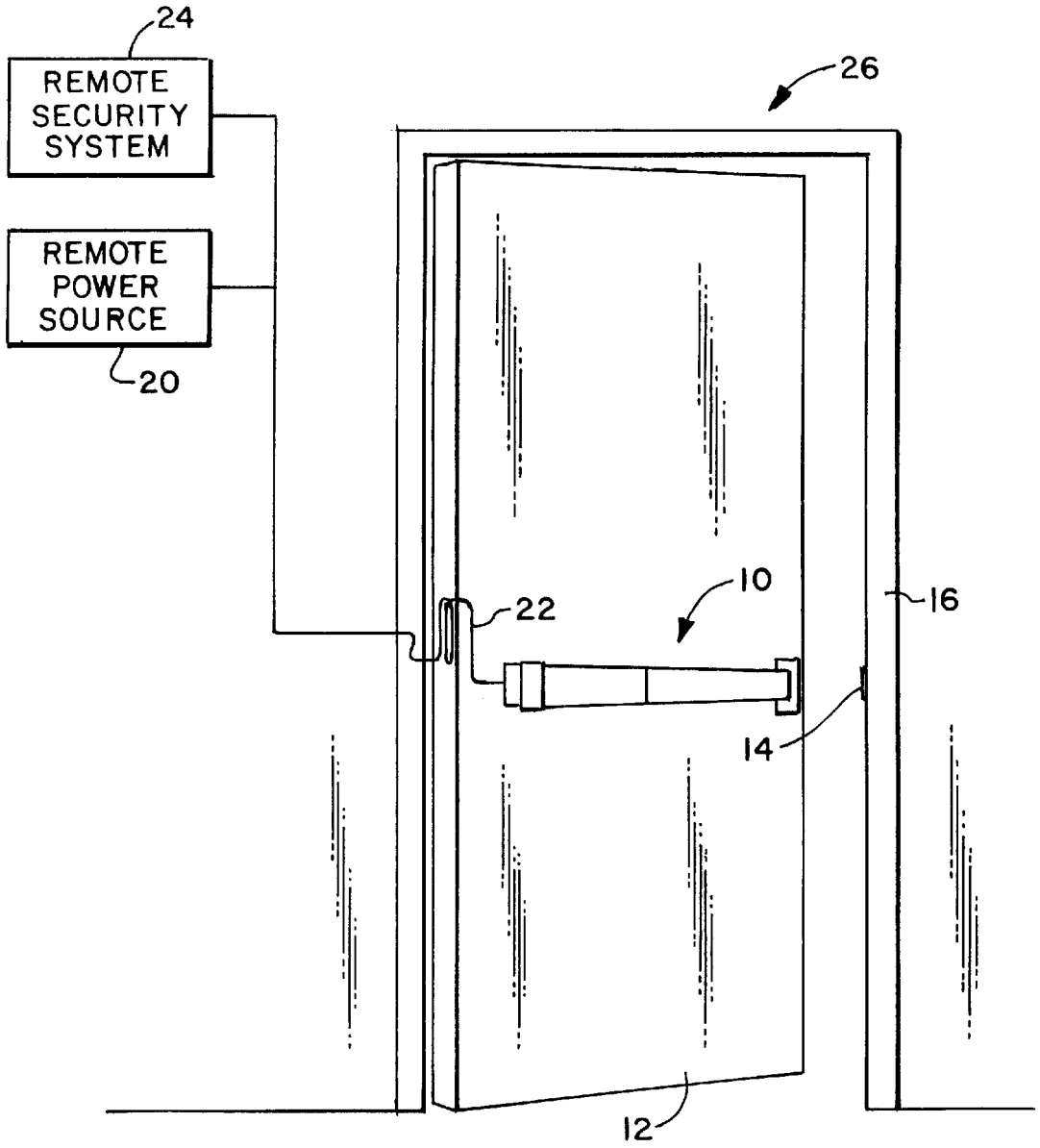
FIG. 1 is a schematic view of an exit bar having an electromagnetic latch retractor in accordance with the invention mounted to a door and illustrating various auxiliary features thereof.

With reference to the drawings, wherein like numerals represent like components or structures throughout the Figures, a locking pole magnet exit bar of the invention is generally represented by the numeral 10. The exit bar 10 is mounted in a horizontal position across the interior side of a door 12 to be secured (FIG. 1). The exit bar 10 latches against a strike 14 mounted to the door frame 16 from which the door 12 is supported. A push force applied at the front of the exit bar 10 retracts the latch 18 from the strike 14 and releases the door 12 to open for egress. Power is supplied to the exit bar 10 from a remote power source 20 over lines 22 in a conventional manner.

The exit bars 10 of the invention are readily adaptable for communication with a remote security system 24. The remote security system 24 can be used to receive alarm information with regard to attempted egress or ingress through the doorway 26.

Figure 2:
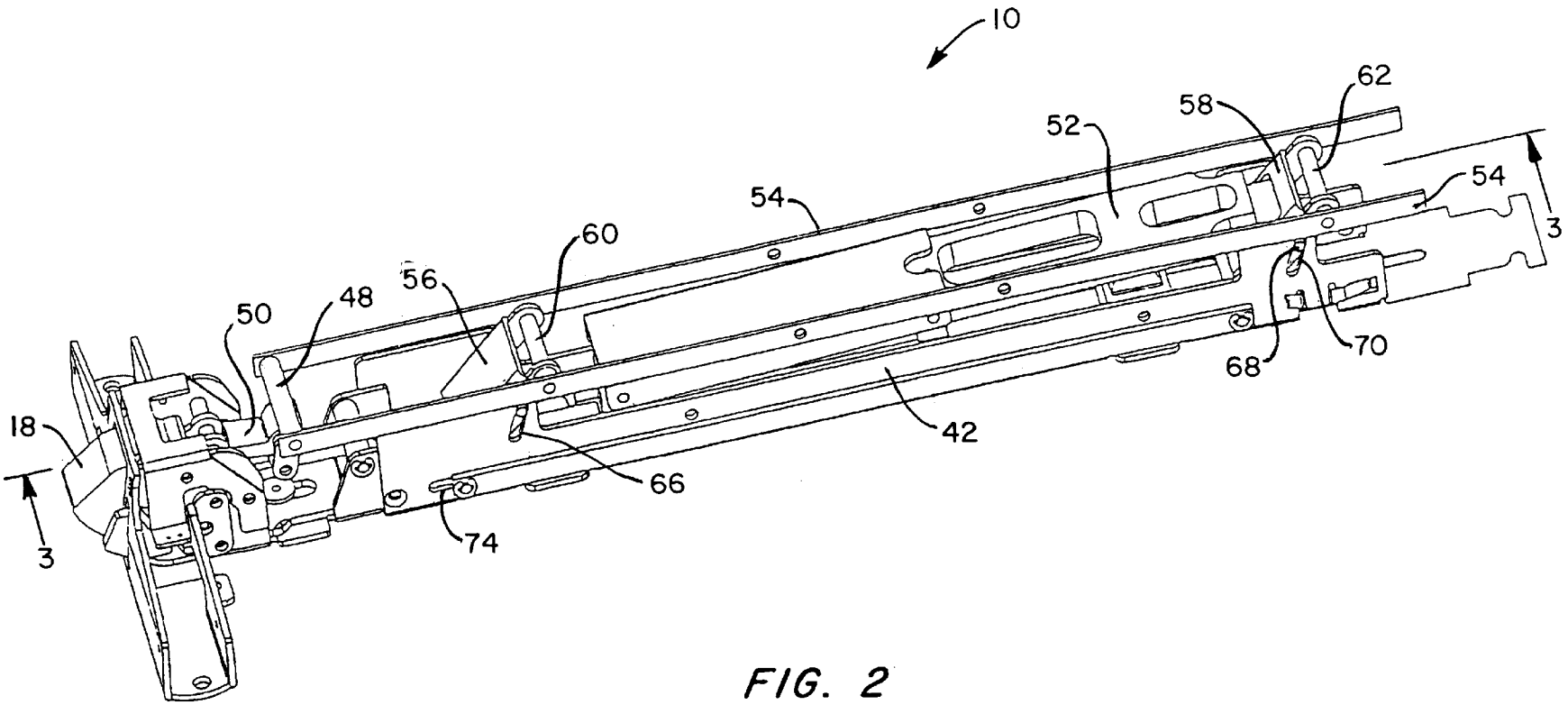
FIG. 2 is a perspective view of the exit bar of FIG. 1, with the housing and the push pad removed, illustrating the latch in the extended position.
Figure 3:
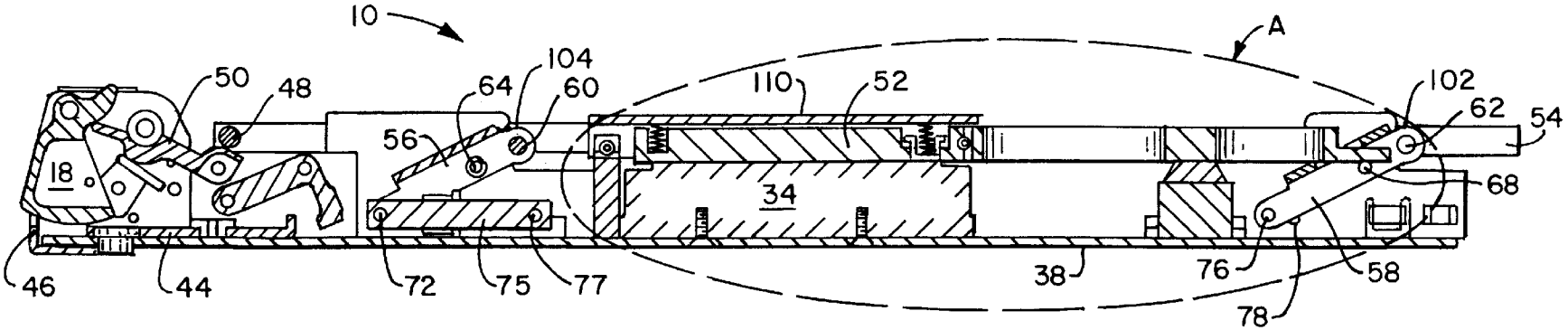
FIG. 3 is a cross sectional view of the exit bar of FIG. 2 taken along the line 3—3 thereof illustrating the latch, armature and link system in the dogged position.
Figure 4:
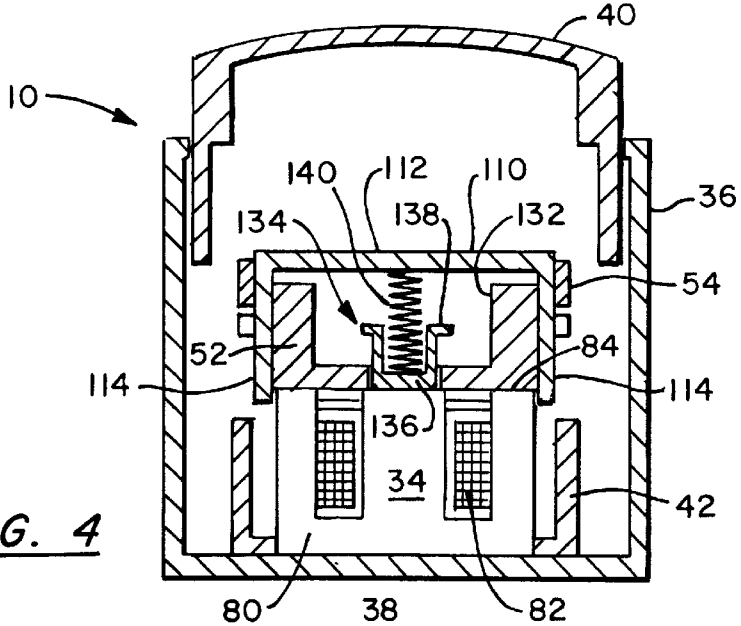
FIG. 4 is a cross sectional view, partially broken away, of the exit bar of FIG. 1.

With reference to FIGS. 2, 3 and 4, the exit bar 10 has an elongated main housing 36 which provides the principal mounting and support structure. The length of the housing 36 is preferably sufficiently long to substantially span the width of the door 12. The main housing 36 is mounted to the door 12 by screws or other fasteners (not shown) which secure the back panel 38 of the housing 36 in surface to surface disposition at the interior (secured) side of the door 12. The main housing 36 is channel-shaped with an elongated opening of the channel being spaced away from the door 12. A transversely displaceable push bar or pad 40 is located in the channel opening. The push pad 40 defines a push face for receiving a push force exerted toward the door by a person attempting to egress through the door 12. The push pad 40 longitudinally spans a substantial portion of the housing 36.

Fixed inside the main housing 36 is a main lock frame 42. The main frame 42 is also generally channel-shaped to define an opening which is also spaced away from the door. The main frame 42 is fixed to the back panel 38 of the housing 36 by screws or other mounting hardware (not shown). For purposes of describing the invention as viewed in the plane of FIG. 4, the housing 36 defines a central longitudinal axis which extends parallel to the back panel 38 and a transverse axis which extends perpendicularly from the panel surface.

The exit bar 10 secures the door 12 by use of a retractable or releasable latch 18 which is pivotally mounted in the latch housing 44. The latch 18 is held in a normally extended or latched position by a latch spring (not shown). The latch spring urges the latch to a first position against strike 14 mounted to the door frame 16. A latch cover 46 surrounds the latch housing 44 to keep contaminants from the latch 18. When push pad 40 is transversely pushed into the housing 36 by a person attempting to egress, a retraction lever drive pad 48 mounted to the push pad contacts a pivotally mounted latch retraction lever 50. The retraction lever drive pad 48 pivots latch retraction lever 50 which contacts latch to pivot latch 18 to a second released or unlatched position whereby the door 12 may be opened.

A push force applied to the push pad 40 is transferred through a series of links and pivots to move an armature 52 in relation to an electromagnet 34. The transverse motion of the push pad 40 is essentially translated by the links and pivots into a motion where the armature 52 swings in an arc from a position at a distance from the electromagnet 34 to a position in full contact with the electromagnet 34.

Push pad 40 is mounted to longitudinally extending drive links 54 which are pivotally linked to the frame 42 for limited transverse movement therewith by a master main link 56 and a slave main link 58. The master main link 56 and slave main link 58 are pivotally connected to the drive links 54 by pins 60, 62. A master main link pin 64 extends through the master main link 56 and slidably engages in master main link pin slots 66 formed by the frame 42. In a similar construction, a slave main link pin 68 extends through the slave main link 58 and slidably engages in slave main link pin slots 70 formed by the frame 42. The master main link pin slots 66 and slave main link pin slots 70 are generally perpendicular to the face of the door 12 upon installation of the exit bar 10.

As viewed in FIG. 3, master main link extends from the drive links 54 to almost the bottom of the channel of the frame 42. A second link pin 72 extends through master main link 56 and slidably engages into master main link lower slots 74 formed by frame 42. The second link pin 72 also pivotally connects the master main link 56 to a first end of a pivot link 75. The second end of the pivot link 75 is pivotally mounted to the frame 42 with a link pin 77. Slave main link 58 also extends to near the bottom of the channel of frame 42. A second slave main link pin 76 extends through the slave main link 58 and slidably engages in slave lower slots 78 formed by frame 42. The corresponding lower guide slots 78, 74 are oriented generally parallel to the face of the door 12 in the longitudinal direction. The construction of the master main link 56 and slave main link 58 with the associated actuation of pins and slots defines a transverse path for the drive links 54 and push pad 40. Upon application of a push force, the transverse motion of the drive links 54 and push pad 40 is translated into a generally longitudinal motion at the bottoms of the master main link 56 and slave main link 58 due to the orientation of the lower guide slots 74, 78.

The links 54, 56, 58, 75, pins 60, 62, 64, 68, 72, 76, 77, slots 66, 70, 74, 78, retraction pad 48 and lever 50 all act in concert as part of a link system to allow the push pad 40 to retract latch 18. The push pad 40 is maintained in an extended position away from the door 12 and the links 54, 56, 58, 75 are maintained in an initial position by the bias of a main spring (not shown).

During periods of high traffic use, it may be advantageous to dog the exit bar 10 in an unlatched or released position. Dogging the latch 18 reduces wear and tear on the latch mechanism and speeds ingress and egress through the doorway 26. When the dogging feature is selected, the electromagnet 34 is energized to unlatch the door 12 and hold the push pad 40 and latch 18 in a dogged or unlatched position. The dogging feature may be accomplished by a signal from the remote site over lines and does not require application of a push force to the push pad 40 to initiate movement of the push pad 40.

Within the exit bar 10, an electromagnet 34 serves to lock the bar (and hence the latch 18) in the dogged position by at least partially limiting the motion of the link system, and therefore locking the latch 18 in the retracted position. The elongated E-shaped electromagnet 34 is fixedly mounted to the back panel 38 of the housing 36. The electromagnet 34 is arranged longitudinally with the long axis of the electromagnet parallel to the long axis of the housing 36 and frame 42. The electromagnet 34 is preferably constructed of a series of stacked E-shaped plates 80 which act as poles of the electromagnet 34. An electromagnet coil 82 is positioned in the slots defined by the stack of E-shaped plates 80. The rectangular ends of the legs of the stack of plates 80 define an attractive magnetic face 84.

Figure 5:
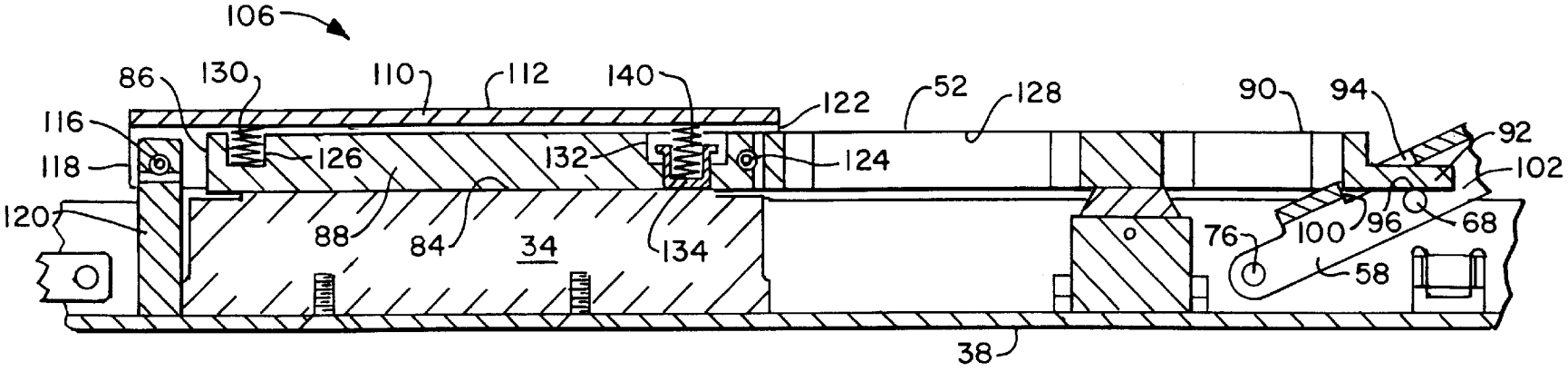
FIG. 5 is an enlarged cross sectional view of Area A of FIG. 2 illustrating the armature and link system in the dogged position.
Figure 6:
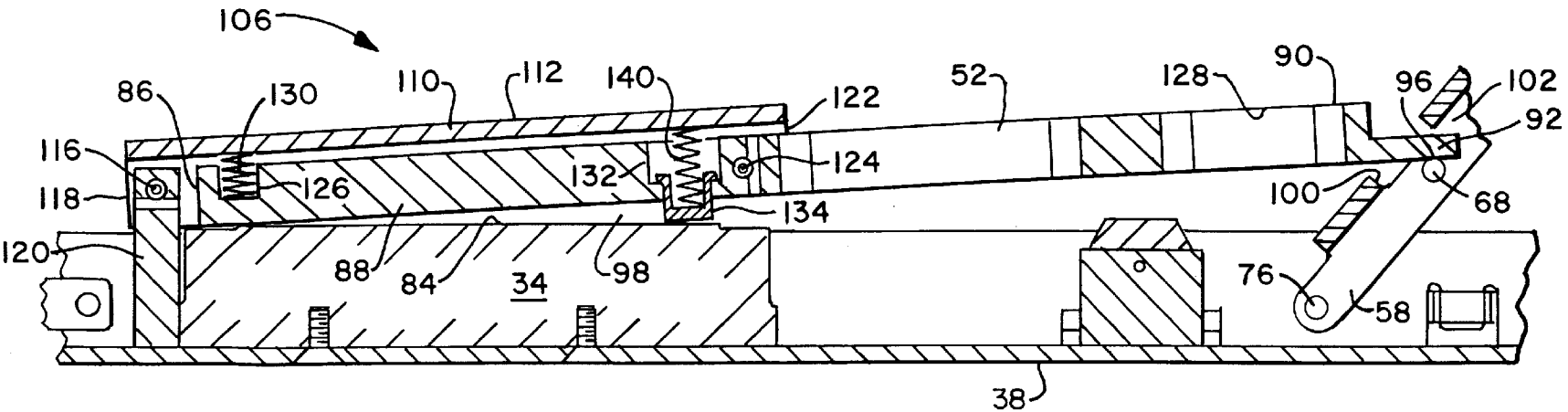
FIG. 6 is an enlarged cross sectional view of Area A of FIG. 2 illustrating the armature and link system in the undogged position.

With reference to FIGS. 5 and 6, the armature 52 extends longitudinally within the frame opening from a proximal end 86 and a proximal end portion 88 disposed adjacent the electromagnet to a distal end portion 90. The proximal end portion 88 of the armature 52 is located so as to have surface to surface contact with the attractive face 84 of the electromagnet 34 when the bar 10 is in a dogged state. The armature 52 is constructed of a ferromagnetic material to provide a strong bond between the electromagnet 34 and the armature 52 when the electromagnet 34 is energized. The distal end portion 90 of the armature 52 terminates in a longitudinally extending locking tab 92. The locking tab 92 extends through a slot 94 in the slave main link 58 to a position adjacent the outboard surface 96 of the slave main link pin 68.

The armature 52 is moveable from a "latched" or "undogged" position (FIG. 6) wherein there is an air gap 98 between all or substantially all of the armature 52 and the attractive face 84 of the electromagnet 34 to a "dogged" position (FIG. 5) wherein the armature 52 is in full contact with the attractive face 84 of the electromagnet 34. The movement of the armature 52 is accomplished by use of the attractive force of the electromagnet 34 on the armature 52.

When the armature 52 is drawn from the latched position to the dogged position by the electromagnet 34, the locking tab 92 engages the inboard edge 100 of the slot 94 and/or the outboard surface 96 of the slave main link pin 68. The movement of the locking tab 92 pushes the outboard end 102 of the slave main link 58 toward the door 12. This causes drive link 54, which is rotatably mounted to the slave main link via pin 62, to move toward the door 12. Drive link 54 pushes the outboard end 104 of the master main link 56, which is rotatably mounted to the drive link 54 via pin 60, and the retraction lever drive pad 48 toward the door 12. The armature 52 is moved in an arcuate path because of the parallelogram-like structure of the links 54, 56, 58 to a position wherein the armature 52 is in full contact with attractive face 84 of electromagnet 34.

The coordinated interaction of the link system (links 54, 56, 58) results in the precisely managed swinging of the armature 52. The movement of the retraction lever drive pad 48 toward the door 12 causes the retraction lever drive pad 48 to contact and pivot the latch retraction lever 50. The latch retraction lever 50 contacts latch 18 to pivot the latch 18 to the released or unlatched position whereby the door 12 may be opened.

Some conventional exit bars include an electronic latch dogging system to maintain the latch in the dogged position during periods of high traffic. Due to the limitations of power supply 20 and conventional exit bar design, the electromagnets of conventional exit bars are unable to provide sufficient magnetic force to draw the armature across the gap between the armature and the electromagnet against the biasing forces of the main spring and the latch biasing spring. Consequently, such conventional exit bars require manual actuation of the exit bar to move the latch to the dogged position and to move the armature into full contact with the electromagnet before the dogging system will hold the latch in the dogged position.

The subject exit bar 10 utilizes a unique mechanical linkage system 106 and power control system 108 to eliminate the requirement for manual activation of the exit bar 10.

The proximal end portion 88 of the armature 52 is positioned within a channel-shaped armature shroud 110. The armature shroud 110 has a front panel 112 disposed intermediate the armature 52 and the push pad 40 and a pair of legs 114 extending laterally from the sides of the front panel 112 toward the door 12 (FIG. 4). An armature shroud pivot pin 116 rotatably mounts the legs 114 of the armature shroud 110, adjacent the proximal end 118 of the armature shroud 110, to a mounting block 120 extending from the frame back panel 38. The legs 114 of the armature shroud 110, adjacent the distal end 122 of the shroud 110, are rotatably mounted to the proximal end portion 88 of the armature 52 by an armature pivot pin 124.

A blind bore 126 extends inwardly from the outboard surface 128 of the proximal end portion 88 of the armature 52. An armature spring 130 is disposed within the blind bore 126 and has a first end engaged with the end surface of bore 126 and a second end engaged with the surface of the armature shroud 110 to bias the armature shroud 110 away from the armature 52. Preferably, the blind bore 126 is positioned adjacent the proximal end 86 of the armature 52. A stepped bore 132 extends through the armature 52 intermediate bore 126 and the armature pivot pin 124. A cup-shaped impact buffer 134 disposed within bore 132 has a bumper member 136 (FIG. 4) which extends through the bore 132 to engage the magnetic face 84 of the electromagnet 34. A radially extending rim 138 of the impact buffer 134 engages a shoulder of the bore 132 to limit movement of the bumper member 136 toward the electromagnet 34. The inboard end of an impact buffer spring 140 is received within the bumper member 136 and engages the bumper member 136 and the outboard end of spring 140 engages the armature shroud 110 to bias the armature 52 away from the electromagnet 34.

As explained above, the proximal and distal ends 118, 122 of the armature shroud 110 are pivotally mounted to the frame 42 (via mounting block 120) and the armature 52, respectively. When no mechanical or magnetic forces are being applied to the push pad 40 and armature 52, respectively, the biasing force of spring 140 causes the armature shroud 110 to pivot about the armature shroud pivot pin 116 relative to the frame 42, pushing the distal end 122 of the armature shroud 110 and the armature 52 away from the frame 42 and electromagnet 34. In addition, the biasing force of spring 130 causes the armature 52 to pivot about the armature pivot pin 124 relative to the armature shroud 110, pushing the proximal end 86 of the armature 52 toward the electromagnet 34. As a result, a wedge-shaped gap 98 is formed between the armature 52 and the electromagnet 34, where the proximal end 86 of the armature 52 is closely adjacent to or preferably in contact with the magnetic face 84 of the electromagnet 34 and the width of the gap 98 increases longitudinally to the distal end of the electromagnet 34, as shown in FIG. 6.

When the electromagnet 34 is energized, the power provided by power control system 108 to the electromagnet 34 produces a magnetic force that in conjunction with the contact between the proximal end 86 of the armature 52 and the electromagnet 34 and the narrow width of gap 98 adjacent proximal end 86 is sufficient to at least partially overcome the biasing force of spring 140. The magnetic force causes the armature shroud 110 to pivot about the armature shroud pivot pin 116 whereby the armature 52 further closes the gap 98. As the armature 52 further closes the gap 98, the magnetic attraction increases, accelerating the movement of the armature 52 toward the electromagnet 34 and allowing the armature shroud 110 to compress springs 130 and 140.

Figure 7:
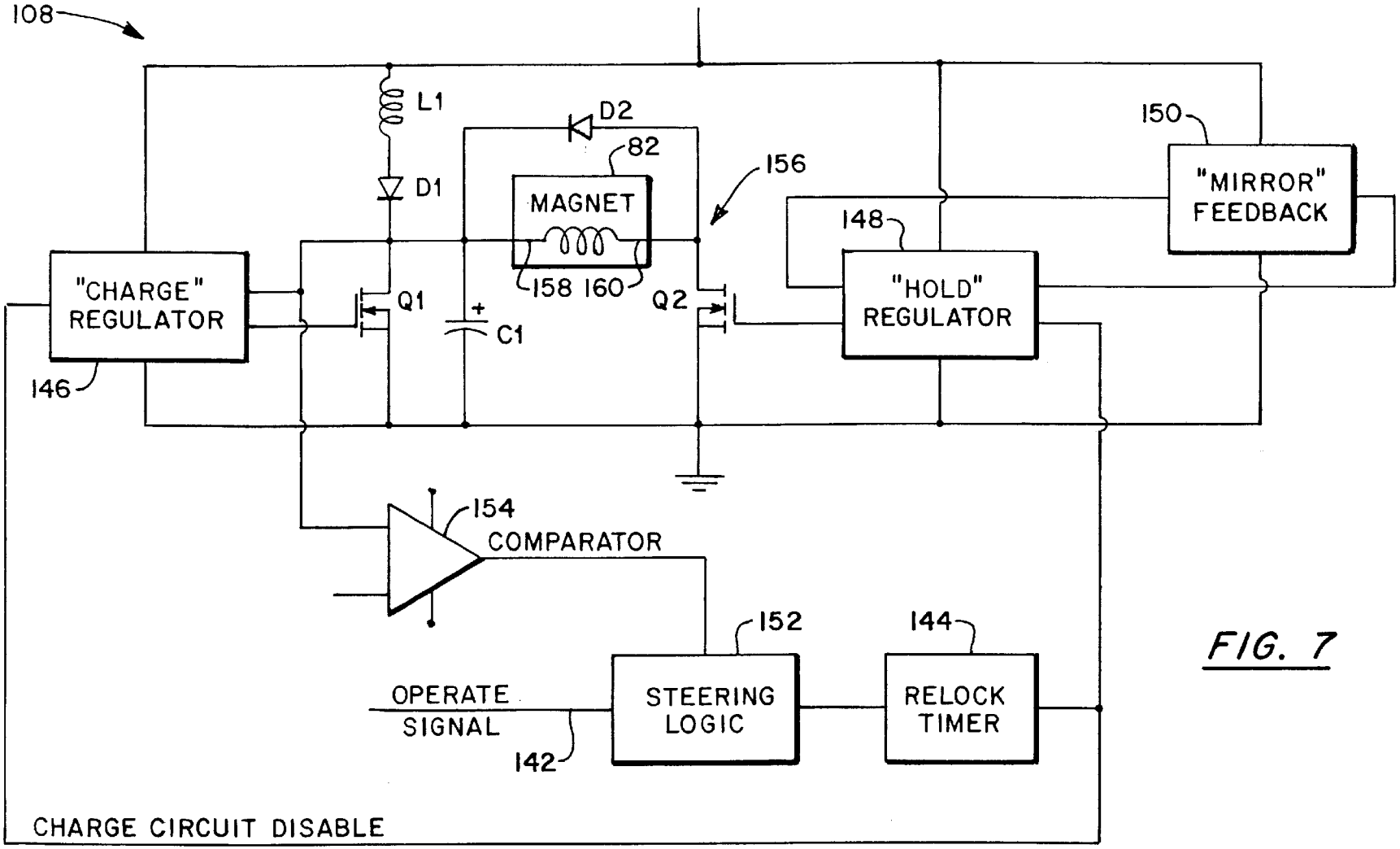
FIG. 7 is a schematic view of the power control system of the exit bar of FIG. 1.
Figure 8:
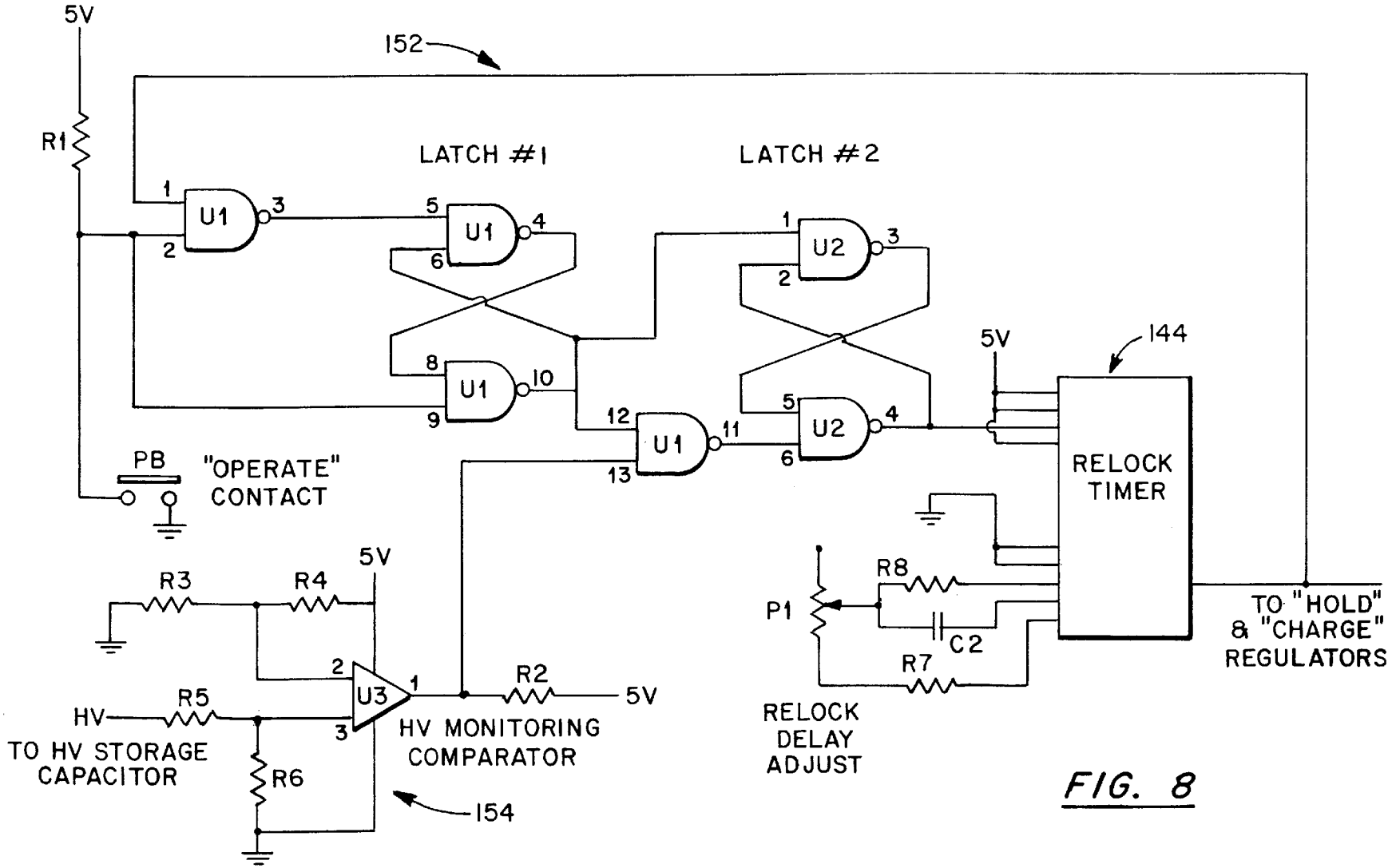
FIG. 8 is a schematic view of the steering logic module of the power control system of FIG. 7.

With reference to FIGS. 7 and 8, the power control system 108 provides a large current for a short time interval to the electromagnet 34 when so ordered by an operate signal 142. The large current assures that the armature 52 (and the masses connected to it) will commence moving toward the dogged position. The power control system 108 subsequently maintains a smaller current flow to the electromagnet 34 which is sufficient to keep the armature 52 in the dogged position. This "hold" state will be maintained for as long as the operate signal 142 is present and as extended by a delay generated by a relock delay timer module 144.

The power control system 108 includes capacitor C1 which receives and stores a voltage charge which is selectively discharged through the coil 82 of the electromagnet 34 to produce the magnetic force described above. A charge regulator 146 controls the charging of capacitor C1 and maintains the charge at the proper level while capacitor C1 is in a wait state. Since the supply voltages for conventional power supplies are either 12 or 24 volts DC, the charge regulator 146 includes a boost type regulator built around a LinTech LT1070 chip to lift and maintain the voltage on capacitor C1 at a higher level, typically 175 volts. The charge regulator 146 also includes inductor L1, diode D1 and power mosfet Q1. The charge regulator 146 is enabled and starts charging C1 as soon as the electromagnet 34 is deactivated by a low level at the output of the relock timer 144. Depending on the limitations of the 12 or 24 VDC power supply, a full charge may take any time from a few hundred milliseconds to a few seconds. The magnet coil 82 is switched on and off by the hold regulator series pass element Q2.

A hold regulator 148 maintains the voltage on the electromagnet 34 at a level sufficient to maintain engagement between the armature 52 and the magnetic face 84 of the electromagnet 34. Generally, a lower level of charge, for example 9 volts, is sufficient to maintain such engagement against the biasing force of the springs. The electromagnet current in the hold state is controlled by pulse width modulation (PWM) to a level that is independent of the variations in the power supply. A mirror feedback module 150 models the magnet voltage to provide a feedback signal referenced to ground for use by the hold regulator 148.

It is undesirable to attempt to activate the electromagnet 34 before a sufficiently large voltage is present at C1 because of the risk of a miss due to insufficient initial force to start the armature 52 and the connected masses in movement. A steering logic module 152 monitors the status of the C1 charge and the existence of a call for operation and allows the activation process to take place only when appropriate. Consequently, the steering logic 152 will record any operate signals 142, even short lived ones, and store them for the moment when the C1 is ready.

Capacitor C1, the electromagnet coil 82 and transistor Q2 form an electromagnet energization circuit 156. One end 158 of the coil 82 is connected to ground via capacitor C1 and the other end 160 of the coil 82 is connected to ground via transistor Q2. Upon receipt of an operate signal 142 from the remote security system 24, pushbutton PB, or other similar input device, the steering logic module 152 provides an output to transistor Q2, closing the energization circuit and initiating discharge of capacitor C1, assuming that there is an adequate charge on capacitor C1. Assuming that the electromagnet 34 is deactivated, a low level (0) on pin 9 of gate U1 (part of latch #1) will send the output of this gate (pin 10) to a high level (1) which is further applied to the next gate, at pin 12. If pin 13 of the same gate is also high, the result will be activation of latch #2 and a high signal at its output (pin 4). This signal will activate the relock timer 144 and the timer output will jump high, enabling the hold regulator 148 and concomitantly disabling the charge regulator 146. Transistor Q2 will turn on and discharge capacitor C1 through the electromagnet coil 82, creating a momentary high current (and consequently a high activation force) in the electromagnet 34. Transistor Q1 will continue controlling the current in the electromagnet 34 past the short timed high current discharge by using PWM control to assure a controlled holding force in the electromagnet 34 with the armature 52 in the dogged position.

When the operate signal 142 is removed and the relock time delay has expired, the charge regulator 146 is restarted. A new incoming operate signal 142 may find capacitor C1 not fully charged and, since the comparator 154 is monitoring capacitor C1 voltage, find the pin 13 at a low level which will prohibit the transmission of the operate signal to latch #2, while retaining its presence on latch #1. Consequently, the activation of the electromagnet 34 will be delayed until the comparator 154 sees the proper charged status of capacitor C1 and allows the passing of the operate signal to latch #2. The feedback of the relock timer output to pin 1 of U1 is provided so as to configure latch #1 to store any short lived operate signal incoming during the C1 charge delay.

The comparator circuits 154 comprise the divider R5/R6 to bring the high voltage level of the voltage on C1 to a convenient low level value. The divider R3/R4 delivers the reference level for monitoring C1 voltage. Other components in the circuit are the timing resistors R7 and R8, delay adjusting trimpot P1, and timing capacitor C2, all part of the timer built around a CD4541 timer integrated circuit.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electromagnetic latch retractor for an exit bar mounted to a face of a door pivotally mounted in a door frame, the door frame including a latch strike, the exit bar including a housing adapted for mounting to the door face, a latch extending from the end of the housing proximate the latch strike for releasably latching the door, a push pad defining an exposed push face for receiving a push force, and a link system linking the pad to the latch for retracting the latch when the pad is pushed, the latch retractor comprising:

an electromagnet mounted within the housing, the electromagnet having a magnetic face;

power supply means for selectively supplying high voltage electrical power to the electromagnet;

an armature having oppositely disposed proximal and distal ends, a distal end portion and an inboard surface disposed oppositely the magnetic face of the electromagnet, the armature being pivotally mounted to the housing at a position intermediate the proximal and distal ends of the armature, the distal end portion of the armature being engageable with the link system; and biasing means having a biasing force for biasing the proximal end of the armature toward the electromagnet and the distal end of the armature away from electromagnet, the inboard surface of the armature and the magnetic face of the electromagnet defining a wedge-shaped gap;

wherein the electromagnet develops a high magnetic field when energized by the high voltage electrical power, the high magnetic field bridging at least a portion of the wedge-shaped gap and imposing a high magnetic force on the armature, the high magnetic force being greater than the biasing force, wherein the high magnetic force pushes the distal end of the armature toward the electromagnet and the distal end portion of the armature engages the link system and moves the link system to retract the latch.

2. The latch retractor of claim 1 wherein the power supply means selectively supplies low voltage electrical power to the electromagnet after the armature has closed the gap, the electromagnet developing a low magnetic field when energized by the low voltage electrical power, wherein the electromagnet and the armature electromagnetically bond to support the latch in a dogged position.

3. The latch retractor of claim 1 further comprising an armature shroud having oppositely disposed proximal and distal ends, a front panel and a pair of legs, the armature being disposed intermediate the pair of legs, the legs being pivotally mounted, adjacent the proximal end of the armature shroud, to the housing and the legs being pivotally mounted, adjacent the distal end of the armature shroud, to the armature.

4. The latch retractor of claim 3 wherein the front panel of the armature shroud is disposed intermediate the push pad and the armature, the armature has an outboard surface disposed oppositely the front panel of the armature, and the biasing means includes a first spring having oppositely disposed inboard and outboard ends, the armature defining a blind bore adjacent proximal end of the armature, the blind bore extending from the outboard surface of the armature to a bore end, the first spring being at least partially disposed within the blind bore, the inboard and outboard ends of the first spring engaging the bore end and the armature shroud, respectively, to bias the proximal end of the armature toward the electromagnet.

5. The latch retractor of claim 4 wherein the armature defines a stepped bore, adjacent the distal end of the armature and the biasing means further includes a second spring and a cup-shaped impact buffer at least partially disposed within the stepped bore, the second spring having oppositely disposed inboard and outboard ends, the impact buffer having a bumper member and defining a receptacle for receiving the inboard end of the second spring, the outboard end of the second spring engaging the armature shroud to bias the bumper member into engagement with the magnetic face of the electromagnet and to bias the distal end of the armature shroud away from the electromagnet, whereby the distal end of the armature is biased away from the electromagnet.

6. The latch retractor of claim 5 wherein the stepped bore defines a shoulder, the bumper member has an outboard end, and the impact buffer further has a lip extending radially from the outboard end, the lip being engageable with the shoulder to limit movement of the bumper member toward the electromagnet.

7. The latch retractor of claim 2 wherein the power supply means includes a power source and a power control system comprising a charge regulator in electrical communication with the power source and a capacitor in electrical communication with the electromagnet, the charge regulator controlling charging of the capacitor to a high voltage level and maintaining the capacitor at the high voltage level until the capacitor is selectively discharged through the electromagnet to supply the high voltage electrical power.

8. The latch retractor of claim 7 wherein the power control system further comprises a hold regulator in electrical communication with the power source and the capacitor, the hold regulator controlling the low voltage level on the electromagnet.

9. The latch retractor of claim 8 wherein the power control system further comprises an external operate signal source, a transistor in electrical communication with the capacitor, and a steering logic module in electrical communication with the capacitor, the transistor, and the operate signal source, the steering logic initiating discharge of the high voltage electrical power via the transistor upon receipt of an operate signal.

10. The latch retractor of claim 9 wherein the power control system further comprises a voltage comparator in electrical communication with the capacitor and the steering logic module, the steering logic module monitoring the voltage charge on the capacitor via the voltage comparator and storing the operate signal if the sensed voltage charge is less than the high voltage level.

11. The latch retractor of claim 9 wherein the transistor is further in electrical communication with the hold regulator, the hold regulator maintaining the voltage on the electromagnet at the low voltage level via the transistor as long as the steering logic module receives the operate signal.

12. The latch retractor of claim 11 wherein the power control system further comprises a relock timer in electrical communication with the steering logic and the hold regulator, the relock timer providing an output to the hold regulator for a predetermined period of time after the steering logic module stops receiving the operate signal wherein the hold regulator maintains the voltage charge on the capacitor at the low voltage level via the transistor as long as the relock timer provides the output.

13. An exit bar mounted to a face of a door having a power supply having a voltage, the exit bar comprising:

a housing adapted for mounting to the door face;

a latch extending from the housing for releasably latching the door;

a push pad defining an exposed push face for receiving a push force;

a link system linking the pad to the latch for retracting the latch when the pad is pushed;

an electromagnet mounted within the housing, the electromagnet having a coil and a magnetic face;

a power control system in electrical communication with the power supply and selectively supplying high or low voltage electrical power to the electromagnet;

an armature having oppositely disposed first and second ends and an inboard surface disposed oppositely the magnetic face of the electromagnet, the armature being pivotally mounted within the housing at a position intermediate the first and second ends of the armature, the second end portion of the armature being engageable with the link system; and biasing means having a biasing force for biasing the first end of the armature into engagement with the electromagnet and the second end of the armature away from electromagnet, whereby the inboard surface of the armature and the magnetic face of the electromagnet define a wedge-shaped gap;

wherein the electromagnet develops a high magnetic field when energized by the high voltage electrical power and a low magnetic field when energized by the low voltage electrical power, the high magnetic field bridging at least a portion of the wedge-shaped gap and imposing a magnetic force on the armature which is greater than the biasing force wherein the armature closes the gap and the inboard surface of the armature engages the magnetic face of the electromagnet and the second end of the armature engages the link system, moving the link system to retract the latch, and the low magnetic field electromagnetically bonds the armature to the electromagnet to support the latch in a dogged position.

14. The exit bar of claim 13 wherein the high voltage electrical power has a voltage which is greater than the voltage of the power supply.

15. The exit bar of claim 13 wherein electromagnet comprises a coil having input and output ends and the power control system comprises an electromagnet energization circuit, including a capacitor connected between ground and the input end of the coil and a transistor connected between ground and the output end of the coil, charge regulator means for charging the capacitor to a high voltage level, and steering logic means for receiving an operate signal, monitoring the voltage of the capacitor, and closing the energization circuit via the transistor when an operate signal has been received and the voltage of the capacitor is equal to or greater than the high voltage level.

16. The exit bar of claim 15 wherein the power control system further comprises hold regulator means for maintaining a low voltage level on the capacitor after the inboard surface of the armature engages the magnetic face of the electromagnet and as long as the steering logic means receives an operate signal.

17. The exit bar of claim 15 wherein the power control system further comprises relock timer means for maintaining the low voltage level on the capacitor for a predetermined period of time after the steering logic means stops receiving the operate signal.

18. The exit bar of claim 14 wherein the high voltage electrical power has a voltage substantially equal to 175 volts.

* * * * *